US007448153B2

(12) United States Patent
Maliner et al.

(10) Patent No.: US 7,448,153 B2
(45) Date of Patent: Nov. 11, 2008

(54) CONTAINER LABEL WITH TEAR-OFF PART

(75) Inventors: Bruce Joseph Maliner, Edgewater, NJ (US); David Pastrich, Plainview, NY (US); James Kenneth Hester, Douglasville, GA (US)

(73) Assignee: Alcan International Limited, Montreal, Quebec (CA)

( * ) Notice: Subject to any disclaimer, the term of this patent is extended or adjusted under 35 U.S.C. 154(b) by 396 days.

(21) Appl. No.: 10/802,346

(22) Filed: Mar. 17, 2004

(65) Prior Publication Data

US 2004/0244242 A1 Dec. 9, 2004

Related U.S. Application Data

(60) Provisional application No. 60/455,416, filed on Mar. 18, 2003.

(51) Int. Cl.
*G09F 3/00* (2006.01)

(52) U.S. Cl. ..... 40/310; 283/81

(58) Field of Classification Search ..... 40/310; 283/81

See application file for complete search history.

(56) References Cited

U.S. PATENT DOCUMENTS

| | | | | |
|---|---|---|---|---|
| 1,896,834 | A | 2/1933 | Brown | |
| 4,312,523 | A | 1/1982 | Haines | 283/18 |
| 4,700,976 | A | 10/1987 | Loose | 283/101 |
| 4,727,667 | A | 3/1988 | Ingle | 40/306 |
| 4,729,811 | A | 3/1988 | DiFrank | 156/449 |
| 5,153,042 | A * | 10/1992 | Indrelie | 283/81 |
| 5,342,093 | A | 8/1994 | Weernink | 285/81 |
| 6,332,631 | B1 * | 12/2001 | Kirk | 283/81 |
| 6,402,872 | B1 | 6/2002 | Key | 156/215 |
| 2003/0180490 | A1 * | 9/2003 | Squier | 428/35.7 |
| 2005/0076549 | A1 * | 4/2005 | Sellars | 40/310 |

FOREIGN PATENT DOCUMENTS

| | | |
|---|---|---|
| GB | A 2 238 772 | 6/1991 |
| GB | A 2 299 568 | 10/1996 |

* cited by examiner

*Primary Examiner*—Cassandra Davis
(74) *Attorney, Agent, or Firm*—Banner & Witcoff, Ltd.

(57) ABSTRACT

A label for a soft drink bottle or other container. The label is an elongated strip of flexible material having first and second ends, inner and outer surfaces and upper and lower edges. A first quantity of adhesive is applied to the inner surface of the strip adjacent to the first end, a second quantity of adhesive is applied to the inner surface of the strip adjacent to the second end, and a third quantity of adhesive is applied to the inner surface of the strip in a region spaced from the first and second ends. A tear line extends laterally across the strip between the upper and lower edges, the tear line being positioned adjacent to the third quantity of adhesive between the third quantity of adhesive and the second end of the strip, and defines an adhesive-free area on the inner surface between the tear line and the second quantity of adhesive. The material of the strip comprising a tamper-evident layer that provides clear indication of peeling of the second end of the strip and/or tearing along the tear line. The invention also relates to a container with such a label and apparatus for applying the label.

6 Claims, 7 Drawing Sheets

CONTAINER LABEL WITH TEAR-OFF PART

CROSS-REFERENCE TO RELATED APPLICATION

This application claims the priority right of U.S. provisional patent application Ser. No. 60/455,416 filed Mar. 18, 2003 by applicants herein.

BACKGROUND OF THE INVENTION

1. Field of the Invention

This invention relates to labels for containers, and methods for producing and applying such labels, was well as equipment used therefor. More particularly, the invention relates to container labels, especially bottle labels, provided with a tear-off part and intended primarily for the beverage industry.

2. Background Art

So-called "backside label" promotions and games have been used regularly for many years by soft drinks manufacturers and bottlers. For such promotions, the back of a bottle label is utilized as a coupon used for redemption or gaming. This requires a full wrap around label to be completely removed to allow the coupon to be used. Recent redemption legislation in various states of the United States and elsewhere now prevents the removal of a label from a bottle since the universal product code (UPC) and other special bottle redemption information provided on the label must remain on the container for the refund and recycling process. This has caused soft drink manufacturers to stop using backside label promotions and to use "under the cap" (UTC) promotions instead. UTC limits the promotional gaming opportunities by limiting the area available for messages and also adds more cost and logistic problems than backside label promotions since the bottler has to match label inventory to cap inventory, which always results in added spoilage of labels or caps. Tampering with packages with removable coupons has also been a serious problem in the market place.

It is known to provide labels for containers with detachable parts that allow part of the label to be detached while leaving the remainder of a label firmly fixed to the container. For example, U.S. Pat. No. 5,342,093 which issued to William Weernink on Aug. 30, 1994, discloses an elongate strip label for wrapping around a pharmaceutical container with an overlap portion. The overlap portion of the label is secured with a transparent release coating. The overlap portion may be peeled away to expose information below.

U.S. Pat. No. 4,312,523, which issued to Russell Haines on Jan. 26, 1982, discloses a label for a pharmaceutical container in the form of an elongated strip. The strip is longer than the container with which it is used so that there is an overlap. This addresses the problem caused by the reduction in container size for pharmaceuticals as well as the need for more product information.

Unfortunately, when providing labels with detachable parts, it is all too easy for dishonest or careless consumers to remove the label parts inappropriately, for example from products stored on supermarket shelves without any intent to purchase.

SUMMARY OF THE INVENTION

An object of the present invention, at least of preferred forms of the invention, is to provide a label for a container, particularly a soft drink bottle, having a detachable part and a part that remains firmly attached to the container.

According to one aspect of the invention, there is provided a label for a container, comprising: an elongated strip of flexible material having first and second ends, inner and outer surfaces and upper and lower edges; a first quantity of adhesive applied to the inner surface of the strip adjacent to the first end; a second quantity of adhesive applied to the inner surface of the strip adjacent to the second end; a third quantity of adhesive applied to the inner surface of the strip in a region spaced from the first and second ends; a tear line extending laterally across the strip between the upper and lower edges, the tear line being positioned adjacent to the third quantity of adhesive between the third quantity of adhesive and the second end of the strip, and defining an adhesive-free area on the inner surface between the tear line and the second quantity of adhesive; the material of the strip comprising a tamper-evident layer.

According to another aspect of the invention, there is provided a labelled container comprising a container wall for enclosing a product and a label as described above encircling the container wall.

According to another aspect of the invention, there is provided a method of producing a label and attaching the label to a container having an outer wall; comprising: providing an elongated band of pre-printed flexible material comprising a tamper-evident layer; cutting the band into a plurality of elongated strips each having first and second ends, inner and outer surfaces and upper and lower edges; for each strip: advancing the strip longitudinally and creating a transverse tear line extending laterally across the strip between the upper and lower edges, the tear line being positioned intermediate the first and second ends; applying a first quantity of adhesive to the inner surface of the strip adjacent to the first end, a second quantity of adhesive to the inner surface of the strip adjacent to the second end, and a third quantity of adhesive to the inner surface of the strip in a region spaced from the first and second ends adjacent to the tear line between the tear line and the first quantity of adhesive; and connecting the first quantity of adhesive to a container, rotating the container to cause the strip to wrap around the container until the third and the second quantities of adhesive adhere to the container or label.

According to yet another a method of producing a label and attaching the label to a container having an outer wall; comprising: providing an elongated band of pre-printed flexible material comprising a tamper-evident layer having a plurality of transverse tear lines at spaced intervals; cutting the band into a plurality of elongated strips each having first and second ends, inner and outer surfaces, and upper and lower edges, with one of the tear lines extending laterally across each strip between the upper and lower edges between the first and second ends; for each strip: advancing the strip longitudinally; applying a first quantity of adhesive to the inner surface of the strip adjacent to the first end, a second quantity of adhesive to the inner surface of the strip adjacent to the second end, and a third quantity of adhesive to the inner surface of the strip in a region spaced from the first and second ends adjacent to the tear line between the tear line and the first quantity of adhesive; and connecting the first quantity of adhesive to a container, rotating the container to cause the strip to wrap around the container until the third and the second quantities of adhesive adhere to the container or label.

According to yet another aspect of the invention, there is provided apparatus for producing a label and attaching the label to a container, comprising: a rotatable support for a continuous elongated band of pre-printed flexible material; a cutter adapted to cut the band into a plurality of elongated strips each having first and second ends, inner and outer surfaces and upper and lower edges; means for advancing the elongated strips; means for introducing a transverse tear line into each strip as each strip is advanced, the tear line extending laterally across each strip between the upper and lower edges, the tear line being positioned intermediate the first and second ends of each strip; a rotating vacuum drum having a perforated outer surface adapted for holding and advancing each elongated strip in succession, the drum having raised projections from the surface at positions corresponding to areas of each strip to receive a quantity of adhesive; a source of adhesive; a roller adapted for receiving adhesive on an outer surface thereof and for application of an adhesive, the roller being positioned adjacent to the vacuum drum for applying a quantity of adhesive to each strip at positions supported by the raised projections of the drum, a conveyor adapted to convey a succession of containers past the vacuum drum at a point where a first end of an elongated strip can be adhered to an outer wall of the container, the conveyor permitting rotation of the containers by the drum to enable a strip to be wound around the container and adhered thereto.

According to still another aspect of the invention, there is provide a vacuum drum for apparatus as defined above, the drum comprising a perforated outer surface, an inner chamber for development of a vacuum, a plurality of raised projections from the outer surface, and a plurality of vacuum ports communicating with the inner chamber, wherein the projections are raised lands adapted to press an overlying label against a gluing roll arranged at three points around the outer surface in the form of a transverse strip at one position, a transverse strip at a third position and a pair of rectangles at a second position, and wherein the vacuum ports are arranged in a row extending transversely of the outer surface at the second position, with one port located in one of the rectangles and another port arranged in a second of the rectangles.

DETAILED DESCRIPTION OF THE INVENTION

Figure 1:
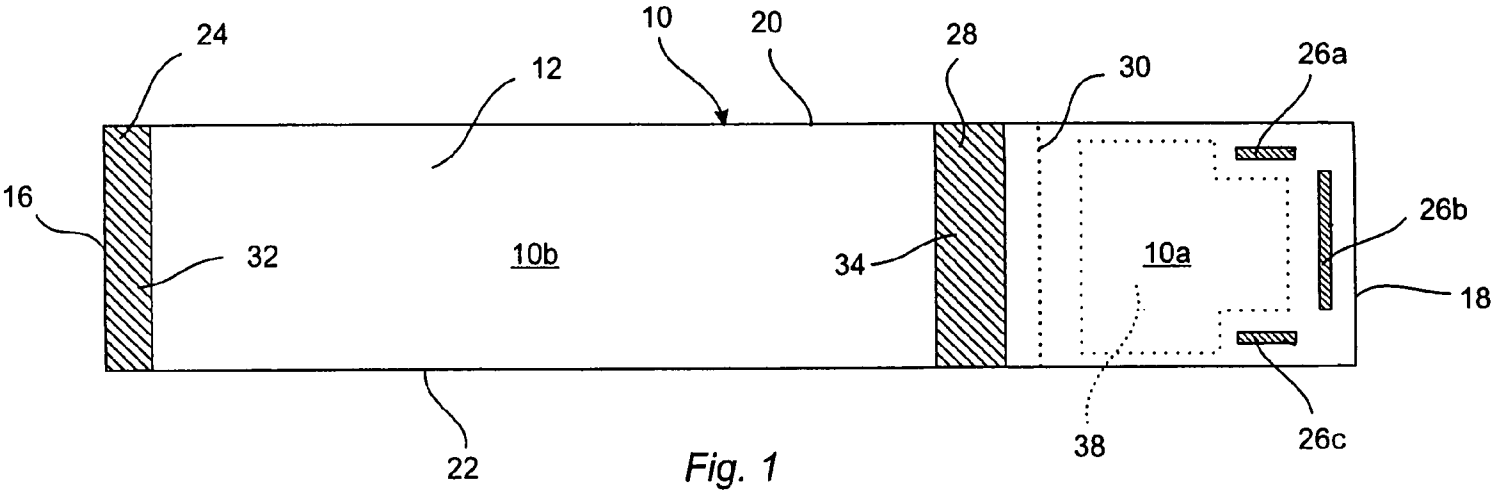
FIG. 1 of the accompanying drawings is a top plan view of a label according to one preferred embodiment of the present invention showing the inner surface.
Figure 2:
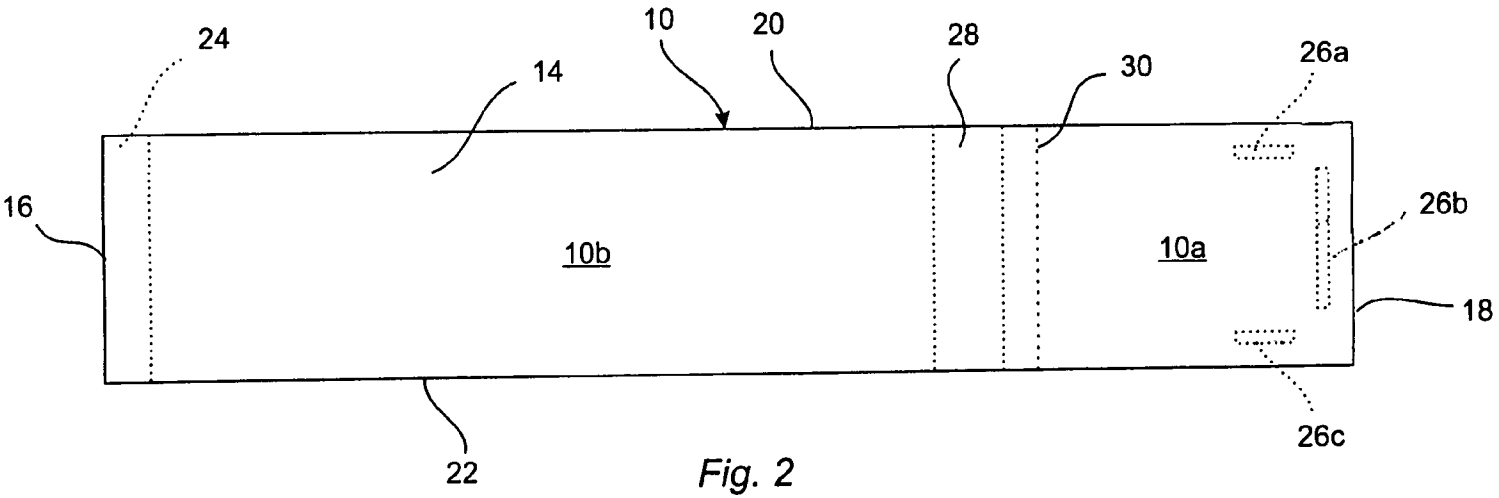
FIG. 2 is a similar view of the label of FIG. 1, but showing the outer surface.

FIG. 1 of the accompanying drawings shows the inner surface 12 (back side) of a label 10 according to one preferred embodiment of the invention. FIG. 2 shows the outer surface 14 of the same label. As will be apparent from these drawings, the illustrated label is elongated, rectangular and has first and second ends 16 and 18, respectively, as well as upper and lower edges 20 and 22, respectively.

The label is provided with a first quantity of adhesive 24 adjacent to the first end 16, a second quantity of adhesive 26*a*, 26*b* and 26*c* adjacent to the second end 18, and a third quantity of adhesive 28 intermediate the first and second ends. The label is also provided with a tear line 30 adjacent to the third quantity of adhesive 28 on the side closest to the second end 18 of the label. The tear line 30 is a line of weakness in the material of the label that facilitates tearing of the label and acts as a guide for the separation of the material as tearing takes place. The tear line 30 may be in the form of a row of perforations or may be a continuous indentation or cut extending only part way through the thickness of the label. The tear line 30 allows part of the label 10*a* to be separated with ease from the remaining part 10*b*. The separated part 10*a* may be used as a voucher, coupon, receipt, collectible item, game device (e.g. scratch-and-win) or the like promotional or security item.

It will be noticed that the first quantity of adhesive 24 is in the form of a continuous layer forming a stripe 32 of intermediate width. The third quantity of adhesive 28 is in the form of a continuous layer forming a wide stripe 34, and the second quantity of adhesive is in the form of three narrow stripes 26*a*, 26*b* and 26*c*, one of which (26*b*) is arranged transversely of the label adjacent and parallel to the second end 18 of the label, and the other two of which (26*a* and 26*c*) are arranged longitudinally of the label parallel and adjacent to the top edge 20 or the bottom edge 22. There is an adhesive-free area 38 (indicated by dotted lines) on the inner surface 12 of the label bounded by the tear line 30 and the second quantity of the adhesive 26*a*, 26*b*, 26*c*. This area will normally bear messages in the form of marking or printing, or a gaming device (e.g. scratch-and-win), or the like (not shown in the drawings). The remainder of the inner surface 12 will normally not bear any marks or printing. However, the outer surface 14 of the label, at least in part 10*b*, will normally be provided with the conventional kind of printing and decoration (not shown) identifying the product and providing product information and information for returning and recycling the container (normally a soft drink bottle made of glass or plastics) to which the label is attached. The outer surface of the label in part 10*a* may be provided with printing or information (not shown) relating to the removable part 10*a*, e.g. instructions regarding how and when to remove this part and promotional details relating to the use of the part 10*a*.

The label 10 is made of a material that incorporates a tamper-evident layer or device. A layer or device of this type leaves clear evidence of tampering if an attempt is made either to remove the removable part 10*a* of the label or to remove the entire label from a container. This will provide a warning to potential purchasers or sales staff that an attempt has been made (successful or not) to remove the removable part of the label from the container or otherwise that the label has been inappropriately handled.

Figure 3:
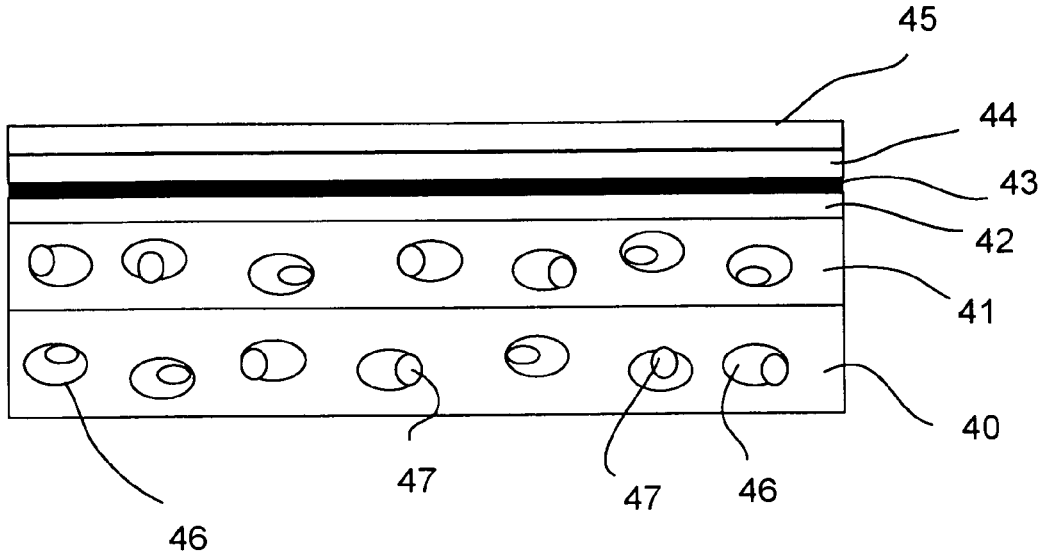
FIG. 3 is an enlarged cross-sectional view of an example of material used to form the label of the present invention.

A particularly preferred material of this kind of label is a laminated oriented polypropylene structure, incorporating a clear layer of oriented polypropylene laminated to a white opaque layer of oriented polypropylene. This white layer is a multi-layered co-extruded material having at least one cavitated core layer and at least one outer bonding layer. An illustration of such a material (on an enlarged scale) is shown in FIG. 3 of the accompanying drawings. In this particular embodiment, the material consists of two core layers 40 and 41 of cavitated oriented polypropylene and a non-cavitated skin layer 42 (e.g. a treated glossy "print skin" layer). The skin layer 42 may form a substrate for a layer of printing ink 43 (e.g. continuous or discontinuous printing of a conventional kind), and the ink layer is covered by an adhesive layer 44 that attaches a clear top layer 45. This structure can be produced in a single co-extrusion and adhesion step. The cavitated core layers 40 and 41 incorporate pores or cavities 46 within the material that make the core layer easy to split or break or fragment if an attempt is made to peel such a material from a supporting substrate such as a mass of adhesive attached to the outer surface of a bottle (not shown). The core material produces what is known as a "fiber tear", i.e. a tearing of the material that leaves a fibrous mass in the area of separation. This fibrous mass is clearly visible and very noticeable, immediately showing that something inadvertent has happened to the material in that area. Moreover, the mass of fiber thereby produced prevents re-attachment of the label and thus prevents concealment of the tampering. The material is therefore a very useful tamper-evident medium that nevertheless is suitable as a label substrate because the skin layer and the cavitated layers are opaque and white. The white color may be imparted by incorporating particles of $TiO_2$ (not shown) in the skin layer and, for greater economy, particles of calcium carbonate 47 in the cavitated core layers 40 and 41.

As noted, the cavitated core layers 40 and 41 are the "tamper-evident" layers of the label structure and the remaining layers are to produce a functional and attractive label. If desired, only one core layer may be provided and, in certain circumstances, it would be possible to omit the adhesive layer 44 and clear layer 45. The various layers normally range in thickness from about 0.5 to 2.0 mils, although the print layer 43 may be much thinner as in conventional printing.

Figure 4A:
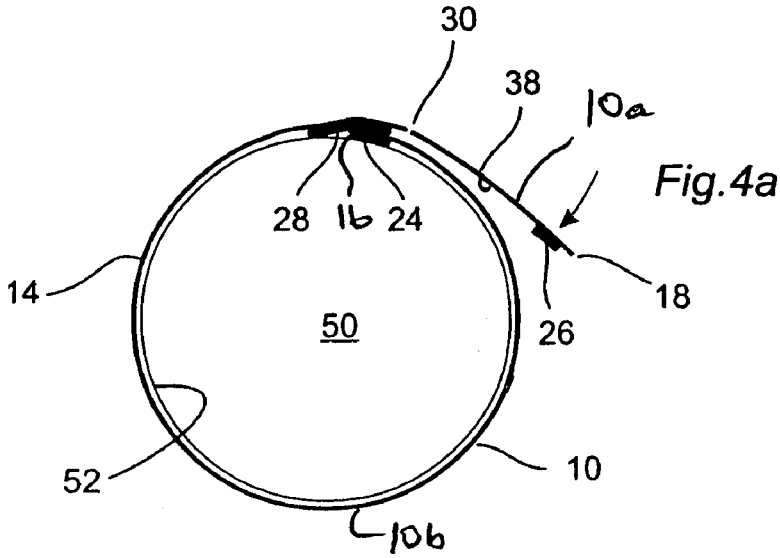
FIG. 4*a* is a cross-sectional view of a label according to FIGS. 1 and 2 in place on a cylindrical container.
Figure 4B:
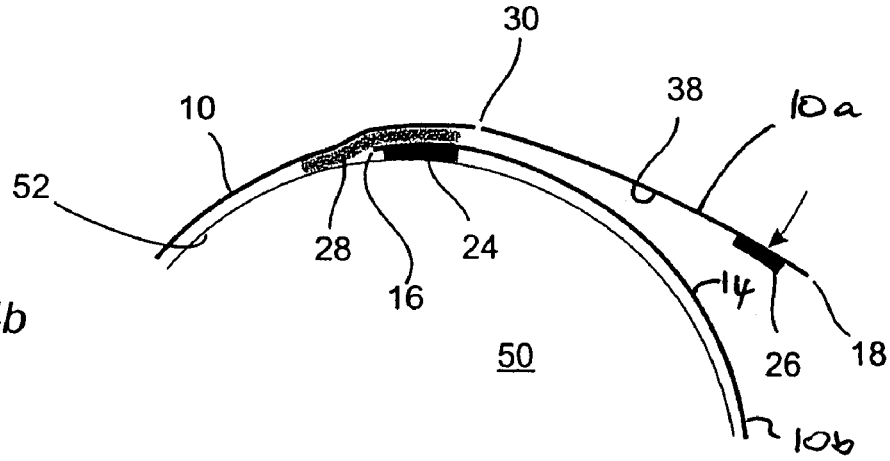
FIG. 4*b* is an enlarged view of a part of FIG. 4*a;*

FIGS. 4*a* and 4*b* show the label of FIGS. 1 and 2 attached to a bottle 50, as an example of a type of cylindrical container with which the present invention may be used. The bottle may, for example, be a soft drinks bottle having a wall 52 made of plastic or the like. The label 10 is wrapped fully around the bottle with the second end 18 overlapping the first end 16. The first quantity of adhesive 24 attaches the first end of the label directly to the bottle wall 52. The third quantity of adhesive 28 attaches the inner surface of the label partly to the other surface of the label at the first end and partly to the wall of the bottle (see the enlargement of FIG. 4*b*). The second quantity of adhesive 26 attaches the second end 18 of the label to the other surface 14 of the label. Hence the label overlaps itself for a considerable distance (but not completely) around the circumference of the bottle.

Attached in this way, the detachable part 10*a* of the label may be described as "peel and tear". That is to say, the second end 18 of the label may be pulled (peeled) outwardly by the user away from the bottle and, when free, the detachable part 10*a* may be torn from the remainder of the label along the tear line 30. This frees the detachable part, leaving the remaining part 10*b* of the label intact and firmly attached to the bottle, completely surrounding the bottle wall. The detachable part 10*a* of the label may form a voucher, coupon, receipt, ticket, game element or the like, for separate use by the purchaser of the bottle. The remaining part 10*b* of the label still provides a fully functional and firmly attached label that may have refund and recycling instructions as well as properly identifying the contents of the bottle and the material from which the bottle is made.

As the detachable part 10*a* of the label is peeled and torn away from the bottle wall, the material of the label in the region of the second quantity of adhesive 26 breaks apart or tears from the adhesive because of the weakness of the internal structure of the label material. There is also fiber formation at the line of weakness 30. This leaves clear and visible evidence of the removal of the detachable part 10*a*, even if the part has been completely detached from the bottle. There will still remain at least some of the second quantity of adhesive, covered by a fibrous mass, attached to the remaining part of the label. A potential purchaser or sales person will therefore instantly recognize that the detachable part of the label has been detached and that the bottle label may therefore have undergone tampering of some kind. Conversely, the lack of any tamper evidence will also give an instant visual verification that both parts of the label are intact. Alternatively, if the label is peeled away but not torn off (e.g. to gain access to information on the backside of the label), tampering will still be evident because the label part 10*a* will not re-adhere to the remainder of the label and its free end will stand away from the remainder of the label. Re-attachment will be prevented by the mass of fiber attached to the second quantity of adhesive that prevents contact and adhesion between the adhesive and the label part 10*a*.

Figure 5:
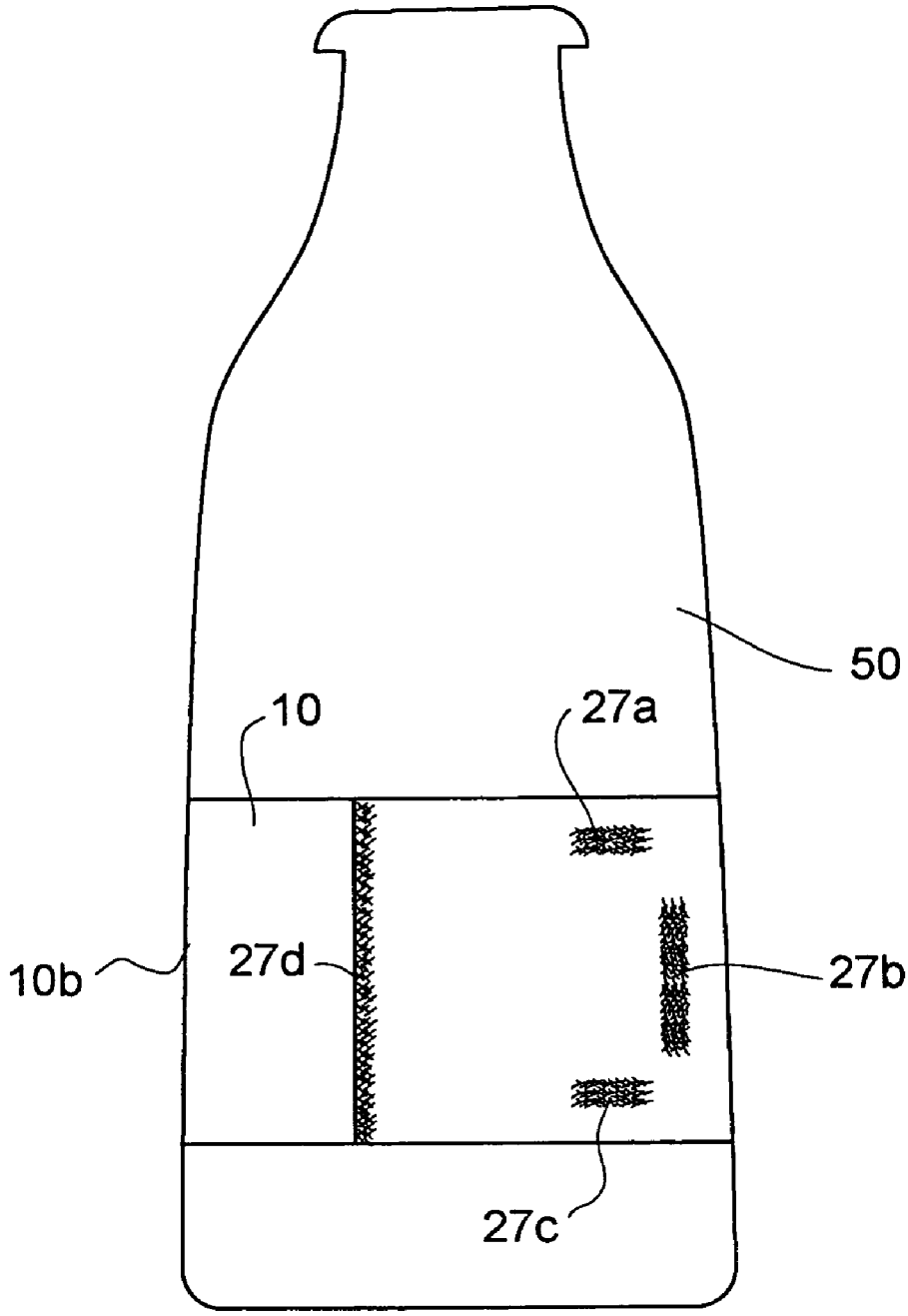
FIG. 5 is a side elevation of a soft drink bottle provided with a label of the kind shown in FIGS. 1 to 3, but with part of the label removed showing the fibrous remnants that reveal the removal of the label part.

FIG. 5 shows the bottle 50 after removal of the label part 10*a*, leaving just label part 10*b*. Label part 10*b* has adhering patches of fiber 27*a*, 27*b*, 27*c* and 27*d* at the points where the label part 10*a* was formerly adhered to the part 10*b*. These fiber patches are difficult to remove and are highly visible. Even to a person who has not seen such a label before, tampering is immediately apparent because the fiber patches indicate partial destruction of the label.

Although the second quantity of adhesive 26 illustrated in the drawings is applied in the form of three narrow stripes 26*a*, 26*b*, 26*c*, this is not essential for the success of the present invention. However, it is generally necessary that the detachable part of the label be peelable from the container without destroying the message or printing on the adhesive-free area 38 of the detachable part. This means that the second quantity of adhesive 26 should be applied to a limited area close to the second end 18 of the label. The second quantity of adhesive may thus have alternative patterns, e.g. discrete dots (e.g. a pair of rectangles spaced apart from each other adjacent to the second end of the label) or spaced lines. The area of adhesive should be sufficient to prevent inadvertent peeling of the label part 10*a* from the remainder of the label during handling and storage of the container, but small enough to allow easy manual peeling without risk of damaging the area 38. The strength of the label itself should be such that the second end of the label is readily manually peelable from the remainder of the label. The adhesive strength is dependent on one or more of the applied area of the adhesive, the amount of the adhesive and its bonding strength. At least one of these may be less than the equivalent value of the third quantity of adhesive 28. This allows the remainder of the label to remain firmly applied to the container as the detachable part is being peeled and torn away. Most preferably, the adhesive is a hot melt pressure sensitive adhesive, e.g. as sold by National Starch Adhesive, Henkel Adhsives and Fuller. A suitable glue strength would be in the range of 200 to 250 grams per linear inch.

The label of the present invention may be used with any kind and shape of container, but it is most advantageous when used with cylindrical containers, particularly soft drink bottles. When this is the case, the label may be applied in a very effective manner, e.g. by means of the apparatus and method shown in FIG. 6 of the accompanying drawings.

The apparatus 60 includes a coil of an elongated band 61 of label material incorporating a tamper evident structure of the kind described above. The band is advanced over rollers 62 and 63 past a station 64 for introducing a transverse tear line 30. The station includes a knife 65 that is moved quickly across one surface of the label material at suitable spaced intervals. In this embodiment, the knife does not cut completely through the label material, but creates a cut that is deep enough to act as the required tear line. The label material then passes around roller 66 and is cut into appropriate label lengths at cutter station 67, thus forming individual labels 10. Each label as it is formed is directed onto the outer surface 68 of a vacuum drum 69. This surface 68 is perforated and holds the label 10 firmly against the perforated surface by virtue of the vacuum applied to the interior of the drum by air pump means (not shown). The surface of the drum has three spaced projections 70, 71 and 72 that cause a covering label 10 to bulge outwardly over the projections while the remainder of the label is held closely against the surface of the drum proper. As the drum rotates in the direction of arrow A, the label is advanced past an adhesive application station 75 consisting of an adhesive roller 76, the surface of which is continuously coated with a layer of adhesive (e.g. hot melt adhesive) by means not shown in the drawings). The adhesive roller is separated from the surface of the drum by a small distance, so that a label held closely against the surface of the drum does not contact the roller. However, in the regions where the label bulges outwardly due to the underlying projections 70, 71 and 72, the label contacts the surface of the adhesive roller and thus receives a layer of adhesive in the shape of the surface of the underlying projection. The surface of the adhesive roller 76 may be smooth or may have a pattern of dots or spaced lines. Thus, the roller may apply a continuous layer of adhesive (when the roller has a smooth surface) or a discontinuous layer of dots or spaced lines. At this stage, a label 10 will have the appearance as shown in FIGS. 1 and 2.

As the drum 69 rotates, it causes an adhering label 10 to converge with a conveyor belt 80 advancing a series of bottles 50 in the direction of arrow B. As the first end 18 of a label contacts a converging bottle, the applied quantity of adhesive attaches the label to the outer wall of the bottle. As the drum moves past the bottle, it causes the bottle to rotate in the direction of arrow C, thus wrapping the label around the bottle until the third quantity of glue partially contacts the bottle and first end of the label. Further rotation of the drum and the bottle then attaches the second end of the label 18 to the bottle (actually to the outer surface of the remainder of the label). The bottle with the label attached then advances away from the drum on the conveyor 80 and on to further stations (not shown), e.g. bottle filling.

The shape and size of the projections 70, 71, 72 and the nature of the surface of the adhesive roller 76 are chosen to ensure that the second end 18 of the label is adhered with a strength that allows the second end to be peeled manually from the bottle when desired. However, the first and third quantities of adhesive are such that the non-detachable part of the label remains permanently attached to the bottle even as the detachable part is being removed.

Figure 6:
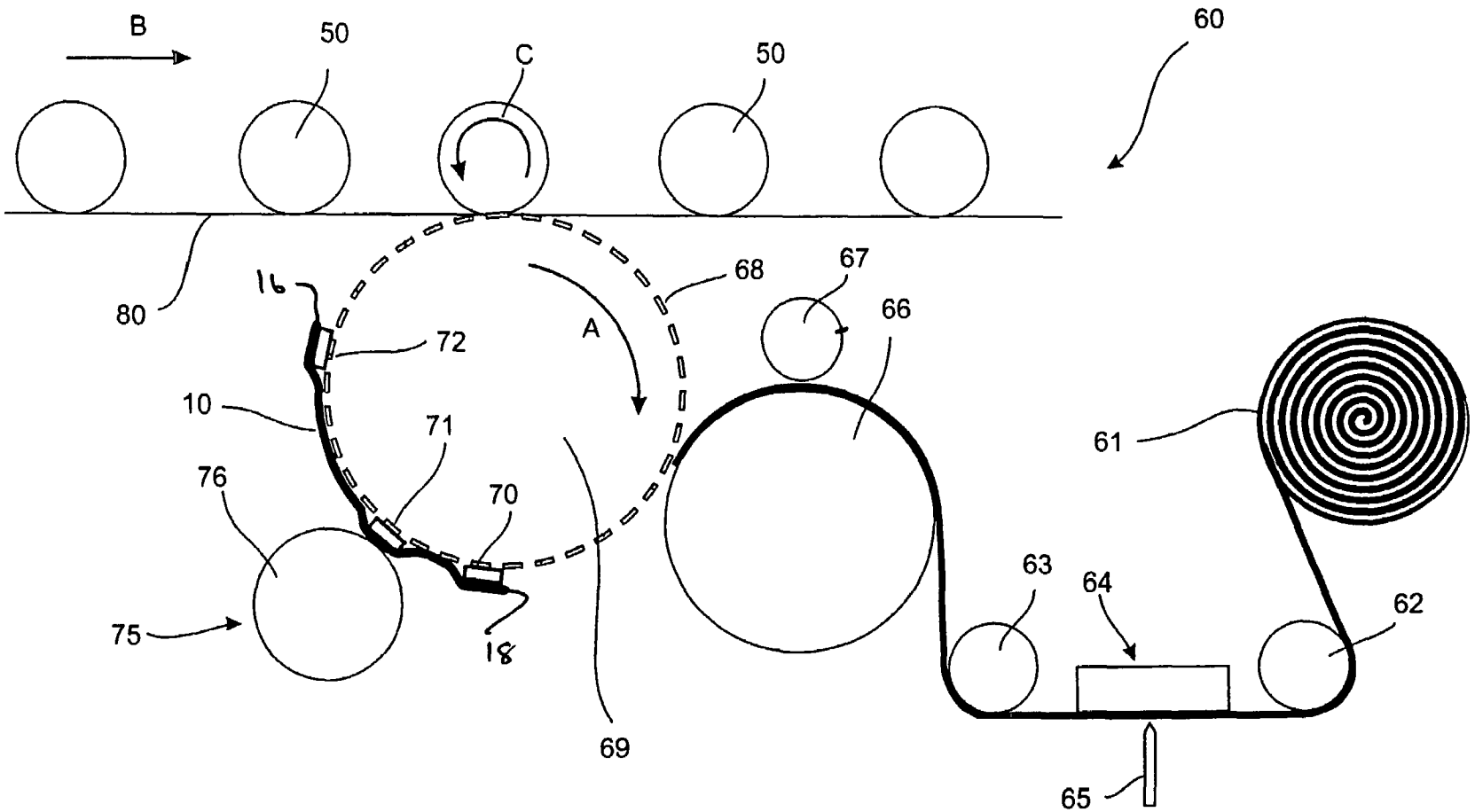
FIG. 6 is a simplified schematic view of preferred apparatus for forming and applying a label according to the present invention.
Figure 7:
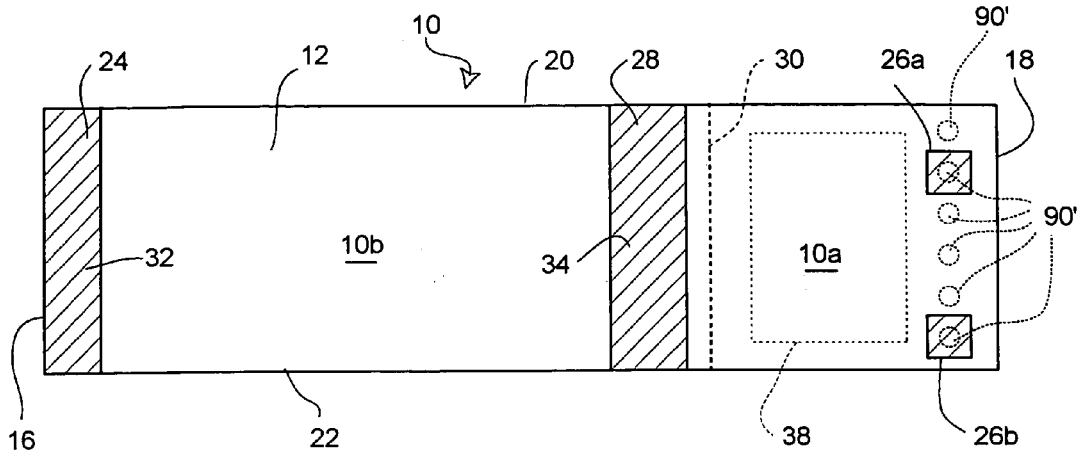
FIG. 7 is a view similar to FIG. 1 of an alternative preferred embodiment of a label of the present invention.
Figure 8:
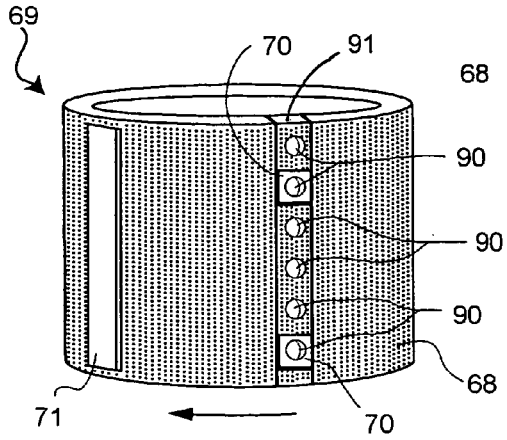
FIG. 8 is a perspective view of a vacuum drum used in labelling apparatus for producing the label of FIG. 5.

A second label design is shown in FIG. 7. This figure shows the inner surface 12 of the label. In this embodiment, the label is essentially the same as the one described in connection with FIGS. 1, 2, 3, 4*a* and 4*b*, except that the second quantity of adhesive is in the form of two small rectangles (or "pads") 26*a* and 26*b* positioned immediately adjacent to the second end 18 of the label 10. The reduced adhesive area provided in this way makes it less likely that the "fiber tear" will extend into the adhesive-free area 38 containing the printed message or gaming device. However, when fabricating this label, it is desirable to modify the vacuum drum 69 of the apparatus of FIG. 6 in the manner shown in FIG. 8. The modification provides a row of enlarged vacuum ports 90 to hold the second end 18 of the label more firmly during the gluing step. The position of these ports relative to the label is shown by the dots 90' in FIG. 7 and it will be seen that the ports extend transversely across the strip in closely spaced relationship when the label is held on the vacuum drum, thus providing enhanced attachment of the second end of the strip to the vacuum drum surface 68. The surface 68 is perforated with small holes as previously disclosed and is provided with a pair of rectangular projections 70 having a shape and position corresponding to the rectangles 26*a* and 26*b* of adhesive applied to the label 12. The projections 70 cause the label to bulge out and to be coated with the adhesive as the label passes the adhesive roller 76. It will be noted that each of the projections 70 is provided with one of the enlarged ports 90 for secure positioning during the gluing operation. In this embodiment, it has been found desirable to make the projections 70 of a harder material than the projections 71 and 72 because the force applied by the adhesive roller is received by the projections of considerably reduced area and excessive wear can be a problem. A harder grade of neoprene or alternative plastics material having higher durometer values (e.g. durometer values of 100 or more) than the materials used for the other projections may be used for these projections. The other projections and preferably the remaining surface of the drum may be made of a softer grade of neoprene rubber. However, it is particularly advantageous to provide the drum with a wall insert 91 of harder material (e.g. 85 to 99 durometer). The wall insert 91 incorporates the projections 70, the enlarged ports 90 and the surrounding drum surface areas. This prevents undue wear in the entire region of the drum contacting the second end 18 of the label.

Figure 9:
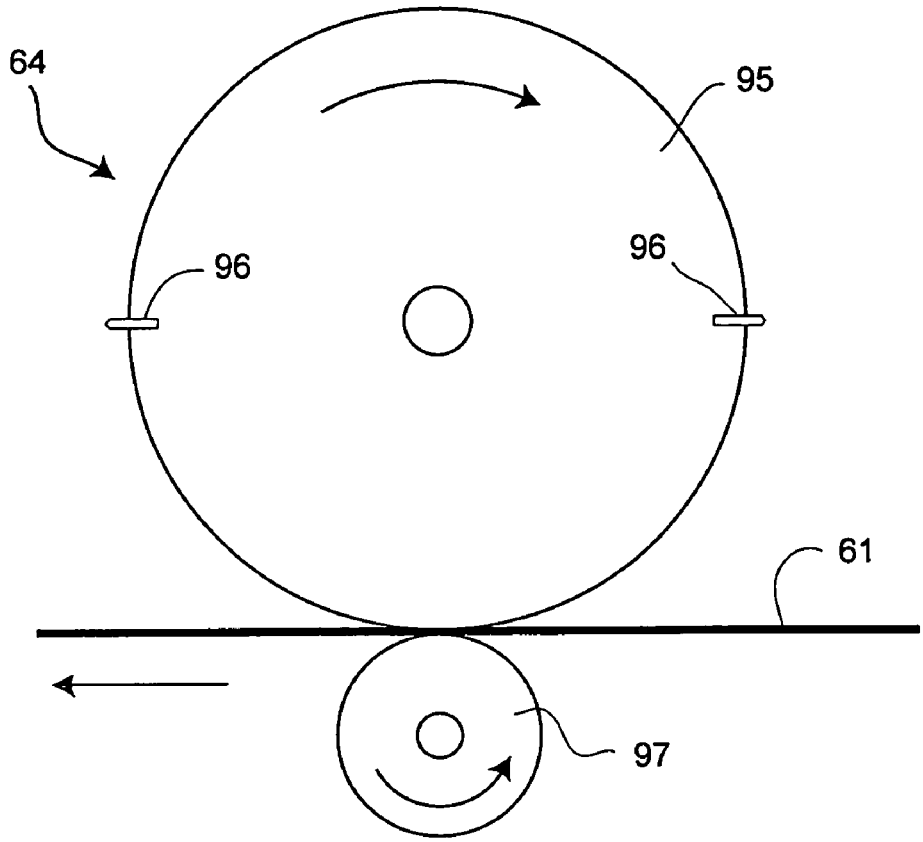
FIG. 9 is a side elevation of an alternative perforation station for the apparatus of FIG. 6.
Figure 10:
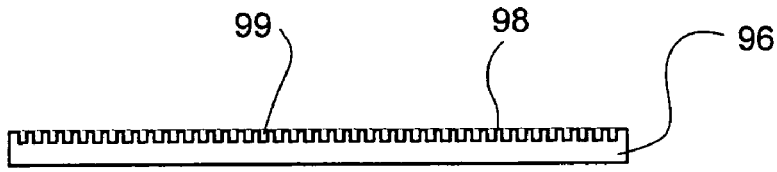
FIG. 10 is a side view of a perforation blade used in the apparatus of FIG. 9.

Another preferred modification to the apparatus of FIG. 6 concerns the station 64 at which the tear line 30 is created. Instead of using a knife 65 that is moved quickly across the surface of the label material, it is possible to provide a perforating cylinder 95 as shown in FIG. 9. The perforating cylinder is provided with two radially-projecting blades 96 that cut into the label material as the label material passes between the perforating cylinder 95 and a backing cylinder 97. One of the blades is shown in side view in FIG. 10 and it will be seen that the blade resembles a comb with tines 98 and gaps 99 designed to produce a line of spaced cuts or perforations through the label. The blades project from the perforating cylinder by a distance corresponding to the thickness of the label material so that the perforations are formed completely through the material. The separation between the blades 96 (i.e. the linear distance around the circumference of the cylinder 95) corresponds to the length of a label, so that each blade perforates the material at the same position relative to the ends of the labels as they are eventually formed. More or fewer blades can be provided on the cylinder according to the label size and the diameter of the cylinder, with the intention being to produce one line of perforations per label. The tear strength of the label along the line of perforations can be controlled by suitably arranging the configuration of the teeth of the blades 96 (i.e. number of teeth per linear measure and spacing between the teeth—which affects the "tie area" size, namely the area of the unperforated strips that join opposite sides of the label together). Tear strength is important because it must be high enough to avoid tearing of the label during application of the label to a container or during container transportation or storage, but low enough to allow intentional tearing by hand when the container is sold and used.

The perforation station 64 may be eliminated entirely if the labels are pre-perforated before entering the labelling apparatus shown in FIG. 6. For example, wide bands of label material may be pre-printed and then perforated at the proper position by a bulk perforator such as a laser perforator (e.g. industrial laser perforating equipment sold under the trade marks AcuTear® and AcuBreathe® by Preco Laser Systems of Somerset, Wis., USA). The band may then be cut into individual rolls of label width suitable for introduction into the gluing and labelling apparatus of FIG. 6 (without perforating station 64). For example, a band up to 45 inches wide (corresponding to 22 labels provided side-by-side) may be pre-printed, perforated and then cut into individual label strips that are wound onto individual rolls for feeding to apparatus such as that shown in FIG. 6.

We claim:

1. A label for a beverage container, comprising: an elongated strip of flexible material having first and second ends, inner and outer surfaces and upper and lower edges; a first quantity of adhesive applied to said inner surface of said strip adjacent to said first end; a second quantity of adhesive applied to said inner surface of said strip adjacent to said second end; a third quantity of adhesive applied to said inner surface of said strip in a region spaced from said first and second ends; a tear line extending laterally across said strip between said upper and lower edges, said tear line being positioned adjacent to said third quantity of adhesive between said third quantity of adhesive and said second end of the strip, and defining an adhesive-free area on said inner surface between said tear line and said second quantity of adhesive; and said material of said strip comprising a tamper-evident structure wherein said tamper-evident structure comprises a frangible material that leaves a residue of fibers when peeled from a quantity of adhesive, wherein said material of said strip comprises a core layer positioned between a pair of bonding layers.

2. A label for a beverage container, comprising: an elongated strip of flexible material having first and second ends, inner and outer surfaces and upper and lower edges; a first quantity of adhesive applied to said inner surface of said strip adjacent to said first end; a second quantity of adhesive applied to said inner surface of said strip adjacent to said second end; a third quantity of adhesive applied to said inner surface of said strip in a region spaced from said first and second ends; a tear line extending laterally across said strip between said upper and lower edges, said tear line being positioned adjacent to said third quantity of adhesive between said third quantity of adhesive and said second end of the strip, and defining an adhesive-free area on said inner surface between said tear line and said second quantity of adhesive; and said material of said strip comprising a tamper-evident structure wherein said tamper-evident structure comprises a frangible material that leaves a residue of fibers when peeled from a quantity of adhesive, wherein said second quantity of adhesive is applied to said label in the form of discrete dots covering an area of said inner surface.

3. A label for a beverage container, comprising: an elongated strip of flexible material having first and second ends, inner and outer surfaces and upper and lower edges; a first quantity of adhesive applied to said inner surface of said strip adjacent to said first end; a second quantity of adhesive applied to said inner surface of said strip adjacent to said second end; a third quantity of adhesive applied to said inner surface of said strip in a region spaced from said first and second ends; a tear line extending laterally across said strip between said upper and lower edges, said tear line being positioned adjacent to said third quantity of adhesive between said third quantity of adhesive and said second end of the strip, and defining an adhesive-free area on said inner surface between said tear line and said second quantity of adhesive; and said material of said strip comprising a tamper-evident structure wherein said tamper-evident structure comprises a frangible material that leaves a residue of fibers when peeled from a quantity of adhesive, wherein said second quantity of adhesive is applied to said label in the form of a pair of rectangles spaced apart from each other adjacent to said second end of the label.

4. A label for a beverage container, comprising: an elongated strip of flexible material having first and second ends, inner and outer surfaces and upper and lower edges; a first quantity of adhesive applied to said inner surface of said strip adjacent to said first end; a second quantity of adhesive applied to said inner surface of said strip adjacent to said second end; a third quantity of adhesive applied to said inner surface of said strip in a region spaced from said first and second ends; a tear line extending laterally across said strip between said upper and lower edges, said tear line being positioned adjacent to said third quantity of adhesive between said third quantity of adhesive and said second end of the strip, and defining an adhesive-free area on said inner surface between said tear line and said second quantity of adhesive; and said material of said strip comprising a tamper-evident structure wherein said tamper-evident structure comprises a frangible material that leaves a residue of fibers when peeled from a quantity of adhesive, wherein said first and third quantities of adhesive are applied to said label as continuous layers forming elongated stripes extending from said upper to said lower edges, wherein said stripe containing said first quantity of adhesive has a width narrower than a width of said stripe containing said third quantity of adhesive.

5. A labeled container comprising a container wall adapted to enclose a product and a label comprising an elongated strip of flexible material having first and second ends, inner and outer surfaces and upper and lower edges; a first quantity of adhesive applied to said inner surface of said strip adjacent to said first end; a second quantity of adhesive applied to said inner surface of said strip adjacent to said second end; a third quantity of adhesive applied to said inner surface of said strip in a region spaced from said first and second ends; a tear line extending laterally across said strip between said upper and lower edges, said tear line being positioned adjacent to said third quantity of adhesive between said third quantity of adhesive and said second end of the strip, and defining an adhesive-free area on said inner surface between said tear line and said second quantity of adhesive; and said material of said strip comprising a tamper-evident structure wherein said tamper-evident structure comprises a frangible material that leaves a residue of fibers when peeled from a quantity of adhesive, wherein said first quantity of adhesive adheres said first end of said label to said wall of said container, said third quantity of adhesive adheres said inner surface of the label partly to said outer surface of the label at said first end and partly to said wall of said container, and said second quantity of adhesive adheres said second end of said strip to said outer surface of said strip.

6. The labeled container of claim 5, wherein said label has a strength and said second quantity of adhesive adheres to said outer surface of said label with an adhesive strength adapted to prevent accidental detachment of said strip at said second end during storage and transportation of said labeled container, but to allow deliberate manual peeling of said second end from said outer surface of said strip.

* * * * *